United States Patent [19]

Horstketter

[11] Patent Number: 4,660,800

[45] Date of Patent: Apr. 28, 1987

[54] BRIDGE OVERHANG BRACKET AND HANGER

[76] Inventor: Eugene A. Horstketter, 400 Regentview Dr., Houston, Tex. 77079

[21] Appl. No.: 793,175

[22] Filed: Oct. 31, 1985

[51] Int. Cl.[4] ..... E04G 13/04

[52] U.S. Cl. ..... 249/24; 249/25; 249/29; 249/211; 249/219 R; 248/235; 14/71.3

[58] Field of Search ..... 248/235; 14/71.3; 249/23, 24, 25, 28, 29, 211, 219 R; 52/677, 678

[56] References Cited

U.S. PATENT DOCUMENTS

| | | | |
|---|---|---|---|
| 1,504,971 | 8/1924 | Pollnick | 248/235 |
| 2,726,432 | 12/1955 | Lemma | 249/219 R |
| 3,376,010 | 4/1968 | Myer | 52/677 |
| 3,383,080 | 5/1968 | Frisbie | 248/235 |
| 3,472,475 | 10/1969 | Rudiger | 248/235 |
| 3,755,983 | 9/1973 | Beckham | 248/327 |
| 3,782,674 | 1/1974 | Smith | 248/284 |
| 3,782,676 | 1/1974 | Boll et al. | 249/211 |
| 3,806,074 | 4/1974 | Ward | 249/211 |
| 3,961,765 | 6/1976 | Brothers | 248/235 |
| 3,981,469 | 9/1976 | Torbet et al. | 248/235 |
| 3,989,219 | 11/1976 | Pruett | 249/211 |
| 4,021,011 | 5/1977 | Karlsson et al. | 248/235 |
| 4,349,491 | 9/1982 | Eyden | 249/25 |

*Primary Examiner*—Cornelius J. Husar
*Assistant Examiner*—Anthony Knight
*Attorney, Agent, or Firm*—John R. Kirk, Jr.

[57] ABSTRACT

A hanger and bracket attached to the hanger for supporting formwork for steel and concrete during the curing stage of a bridge deck overhang is described. A hanger attached to the beam of the bridge supports a connector carrying the bracket. The connector is maintained in a substantially vertical position. The bracket is adjustable in both horizontal angle and in grade because of pivotally attached horizontal members, an adjustable compression leg, and connector means. Once the cement is set the bracket may be recovered for reuse.

21 Claims, 18 Drawing Figures

BRIDGE OVERHANG BRACKET AND HANGER

BACKGROUND OF THE INVENTION

The present invention relates to a bracket suspended from a hanger on the outermost beam of a bridge deck. The bracket is necessary for the support of formwork and steel and poured-in-place concrete until the concrete has cured and will support itself. The bracket is then removed for use elsewhere.

The prior art has numerous methods of temporarily supporting the concrete in the plastic state. Several well known methods employ metal hangers straddled to the top flange of the beams and connected to forms by bolts or other connectors. One common method is referred to as the needlebeam and consists of a structural steel or timber beam hung from the bottom flange of the outside beam, extending out under the overhanging slab and under the adjacent interior beam for reaction. A jack is provided to support and adjust the form from this fixed position beam. This method requires substantial scaffolding for installation and removal, the tall jacking means and the necessity to work from underneath to adjust the form.

The most popular prior art method is the use of the structural steel bracket that is suspended by means of a bolt, usually at a 45° angle, from a hanger anchored to or installed to straddle the top flange of the exterior beam. U.S. Pat. Nos. 3,755,983; 3,782,674; 3,806,074; and 3,981,469 all reveal the use of such a structure. The brackets currently commercially available all make use of this type of suspension. The compression support member is adjustable along with means for vertically adjusting the height of the bracket. Yet, there are disadvantages to using this bracket. When a superimposed load is applied at the heel of the bracket close to the beam, the bolt tends to swing toward the vertical and when a load is applied near the distal end of the bracket, the bolt tends to swing toward the horizontal. In either case, the entire bracket obviously shifts from its adjusted position in a "rocking chair" effect, making calculation of its carrying capacity indeterminant.

This rocking chair effect is particularly troublesome when the state of the art concrete slab placement equipment is used. Generally two machines are used, a concrete distributor and a concrete finisher. When these machines are put to use across the brackets themselves, the brackets must support extremely high loads for a short period of time as the distributor or the finisher machines roll across them. Since the machines must, if full advantage of the machine's function is to be realized, be supported outside the extreme portion of the concrete, the load imposed by these machines creates the objectional "rocking chair" effect making the results of the pour unacceptable.

The present invention retains the advantages of existing art since the bracket can be installed and completely adjusted by workman working from the top of the beams and formwork without the use of scaffolding and can be removed by use of a simple scaffold suspended from the completed bridge, while eliminating the rocking chair effect, and making calculation of carrying capacity determinant and finite. The present invention provides for the full efficient use of the state of the art concrete slab placement equipment and provides adjustment features not present in any prior art form support brackets.

Generally, it is an object of the invention to provide a statically determinant support bracket for the formwork, steel and concrete while in the plastic state and through the curing period of the concrete installed on bridge and deck overhangs.

A more specific object of the invention is to provide a hanger and bracket joined through a substantially vertical connection which assumes vertical load and horizontal loads without experiencing the rocking effect associated with prior art hangers.

It is a further object of the invention to provide a support bracket which is adjustable as to both elevation and slope relative to the beam to which it is attached.

It is a further object of the invention to eliminate the need for scaffolding in the installation of the bracket in that all installation, adjustment, and final placement of the bracket is performed by workmen from the top of the bridge beam.

It is another object of the invention to provide a bracket which does not require any jacking or support means from the ground or from a structure other than the bridge beam to which it is attached.

It is another object of the invention to provide a bracket which can be folded and easily stored, handled and transported to and from job sites.

It is another object of the invention to provide an equipment rail mounting device which is adjustable both vertically and horizontally and which can not be positioned so as to not cause the torque or bending moment resulting from the superimposed load upon the rail mounting device to overload the bracket or bridge beam.

SUMMARY OF THE INVENTION

In order to accomplish the objects of this invention a hanger is installed on the top of the outside bridge beam which is to carry the brackets. This hanger can be installed by welding, bolting or any other well known technique which rigidly attaches the hanger to the beam. The hanger is provided with a recess into which the top of a bolt and the top proximal end of the bracket can be inserted so that horizontal loads are transmitted to the hanger independent of the bolts hanging in the recess. The hanger and the nut which hold the bolt onto the hanger will be covered and permanently embedded in concrete. The bolt which hangs in the recess of the hanger has the threaded end extending above the surface of the hanger and a nut attached thereto. The bolt then extends vertically down from the hanger and secures the substantially vertical connector of the bracket. This short vertical section attaches to arms of the first horizontal member which is connected to a second horizontal member via a pin which allows the second horizontal member to rotate relative to the first horizontal member in response to an adjustment means. This adjustment means provides for changing the angle of the second horizontal member relative to the first horizontal member. The bracket includes a diagonal compression member and a tension member, both of which are adjustable in length and angle.

A further feature of the invention includes a rail support means so that the brackets in position not only carry all loads imposed by the formwork and the concrete in the fluid and plastic stage but also any superimposed loads resulting from modern concrete placing and surfacing equipment moving across rails carried by the distal ends of a series of brackets on a bridge.

The distal end of the diagonal compression member is kept within proximity of the equipment support rail by a stop means to prevent the bending moment assumed by the bracket as caused by the load on the support rail from exceeding workable limits. The diagonal compression member bears against the outside vertical side of the bridge beam and is fixedly adjustable as to length and position on the second horizontal member in that it is comprised of two telescoping tubes capable of being locked at a certain length. The end of the compression member which bears against the beam takes the form of a "T" head to provide lateral stability of the member against the side of the beam. The horizontal members and diagonal member are connected proximate the beam with an adjustable tensile member, preferably a chain. The bracket is fully adjustable before being placed on the beam. Initially the bracket is placed on the hanger and allowed to hang loose resting against, and parallel to, the beam. Final installation begins with swinging the bracket out to a 90° angle from the beam with a level tool using the hanging bolt as a fulcrum and tightening the bolt onto the hanger. This connects the first horizontal member rigidly to the beam. The formwork is constructed in preparation of the steel erection and concrete placement. Any fine tuning of elevation and slope of the formwork is accomplished by adjusting the second horizontal member through rotation of the adjusting nuts while the workman is supported by the form itself, not an exterior scaffold.

DETAILED DESCRIPTION

Figure 1:
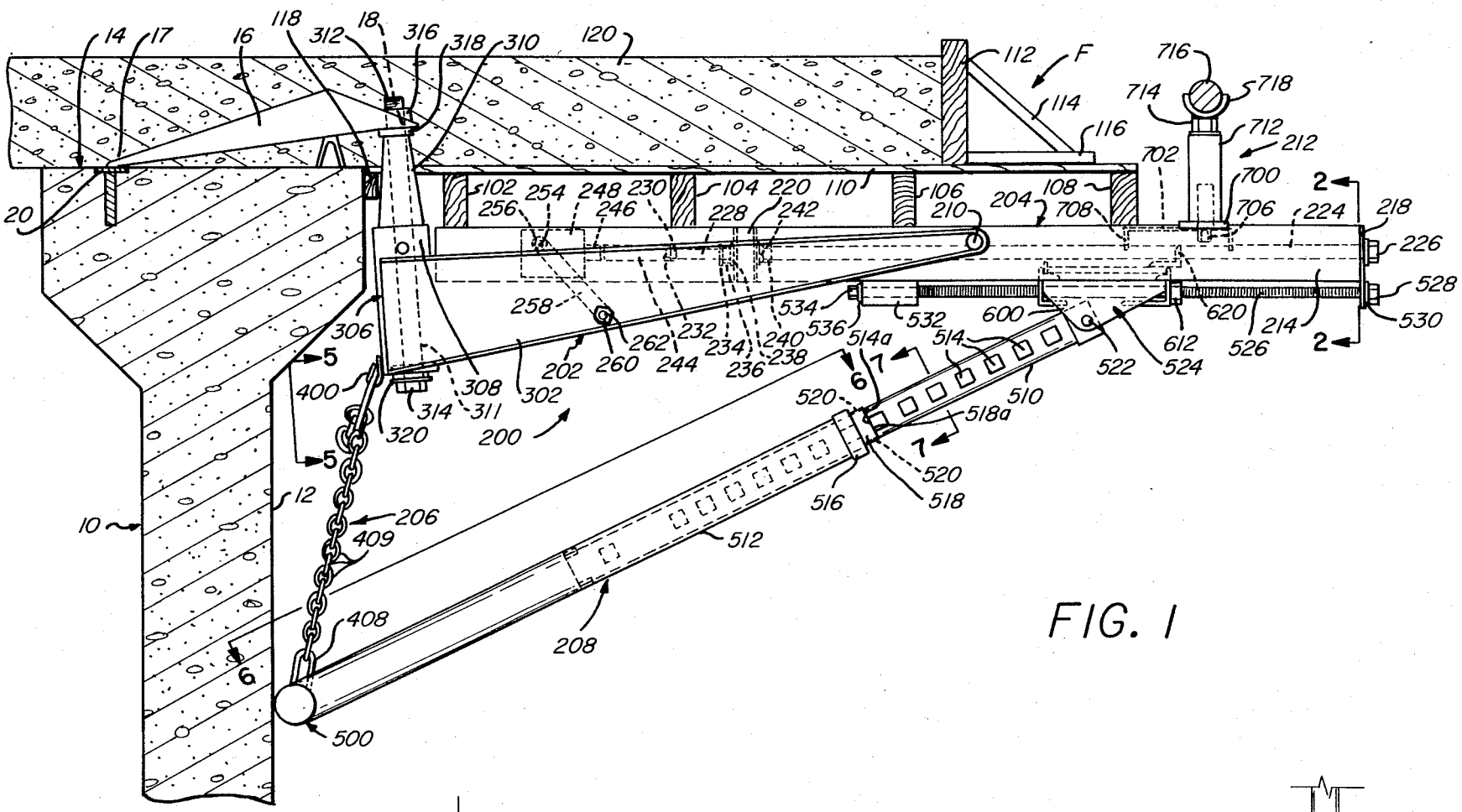
FIG. 1 is an elevation showing the bracket in place at the outside of a beam and concrete held by the form supported by the bracket.

The concrete temporary support bracket is designed to be installed outside the outermost beam of a bridge deck. FIG. 1 illustrates the bracket 200 in working position with the wooden deck 110 of formwork F in place and concrete 120 poured.

Concrete beam 10 has the bracket secured to it by hanger 16 which is connected in the embodiment shown to top surface 14 of the bridge beam 10. This connection is accomplished, for example, by welding, to rigidly attach proximal end 17 by hanger 16 to steel "T" plate 20 which is embedded into concrete beam 10. Of course, other well known means of attachment can be used. In the practice of the invention beam 10 can also be a steel I beam whereby the hanger 16 would be welded to the upper surface of the top flange of the beam.

The bracket 200 is generally triangular in shape and is made from four basic structural members, each of which will be discussed in greater detail below. The horizontal section of the triangle is composed of a first horizontal member, 202, and second horizontal member 204, pivotally connected by pin 210 such that the second horizontal member 204 is disposed in an adjustable angular relation with the first horizontal member 202, which angle is adjustable about pin 210. First horizontal member 202 connects to hanger 16 via bolt 312 outside and, as shown in FIG. 1, above the upper surface of beam 10. Second horizontal member 204 is connected via pin 210 and pin 262 to first horizontal member 202. Second horizontal member 204 provides support for the formwork F hereinafter described which holds the concrete 120 in place. Second horizontal member 204 also carries adjustable rail support 212 which provides a support for track 716 for a concrete placing machine (not shown). The remaining structural elements of the bracket 200 connected to first horizontal member 202 and second horizontal member 204 are a substantially vertical tension member 206 and the diagonal compression member 208.

Tension member 206 is connected at one end to first horizontal member 202 and to compression member 208 at the other. Preferably, this member is a chain, as shown. Compression member 208 is connected at one end to the distal, or outer, end of second horizontal member 204 and is held in position at the proximal end, bearing against the beam 10, by the tension member 206 thus completing the generally triangular shape of the bracket 200. Both tension member 206 and compression member 208 are incrementally adjustable in length allowing for approximate positioning of the bracket 200 prior to placing into position on the beam 10. Thereafter, fine tuning of horizontal leveling and grading occur through adjustments described hereafter.

Second horizontal member 204 supports wooden formwork F, having longitudinal pieces 102, 104, 106, and 108 as shown, which bridge the gaps between brackets spaced along the outward longitudinal side of the bridge beam 10. The wooden form pieces in turn support the wooden deck 110 which supports wet concrete 120 along with the reinforcing steel within the concrete (not shown) during the plastic and curing steps. Vertical support for the outer edge of the concrete is demonstrated by vertical form 112 which is held in place through form supports 114 and 116, all of which are in turn supported by wooden deck 110. Upper surface of deck 110 is shown to be substantially coplanar with the upper surface 14 of beam 10. The elevation of deck 110 relative to the beam 10 can be raised in several ways using the bracket of this invention (described later); i.e., for example, through adjustment in the position of second horizontal member 204, through use of different sized form pieces, use of different vertical connectors, or adjustment of height of first horizontal member 202 along the vertical connector.

To stiffen the edge of deck 110 where deck 110 meets beam 10, and to allow for deck 110 to be positioned above the top 14, of beam 10, ledger 118 is attached to the inner edge of deck 110 as shown. The ledger 118 also acts as a restricting edge for fluid concrete when deck 110 is positioned above the upper surface 14 of the beam 10.

Figure 1A:
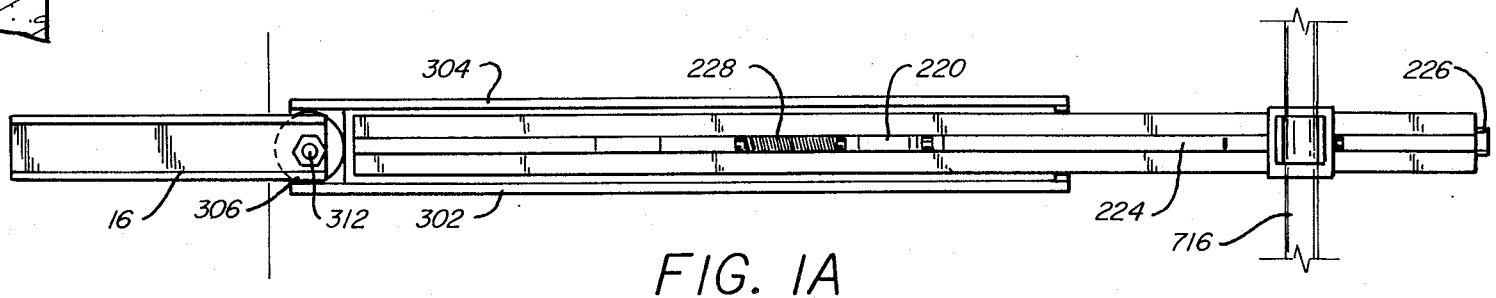
FIG. 1A is a top view of the bracket of FIG. 1 without illustrating the concrete and forms.
Figure 2:
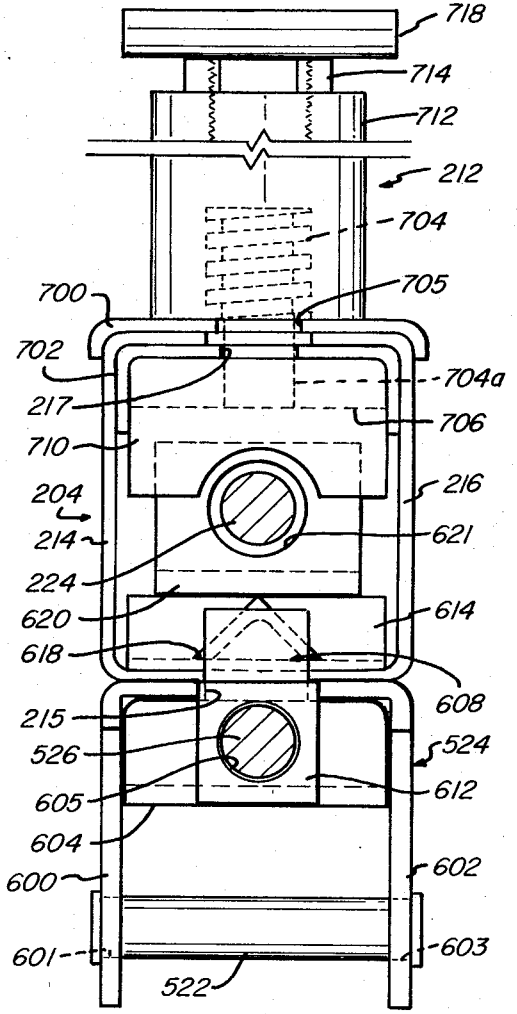
FIG. 2 is an end view of the bracket of FIG. 1 along lines 2—2.

Referring to FIG. 2, which is an end view of second horizontal member 204 along line 2—2 (FIG. 1), it is shown that second horizontal member 204 is constructed of two "C" channels 214 and 216. Channels 214 and 216 are connected to form a generally rectangular member with a longitudinal slot, as shown in FIG. 1A, extending the length thereof, said connection via end plate 218, pin 210, sleeve 532 and by a rectangular tube 220 shown in FIG. 1 and 1A.

Figure 3:
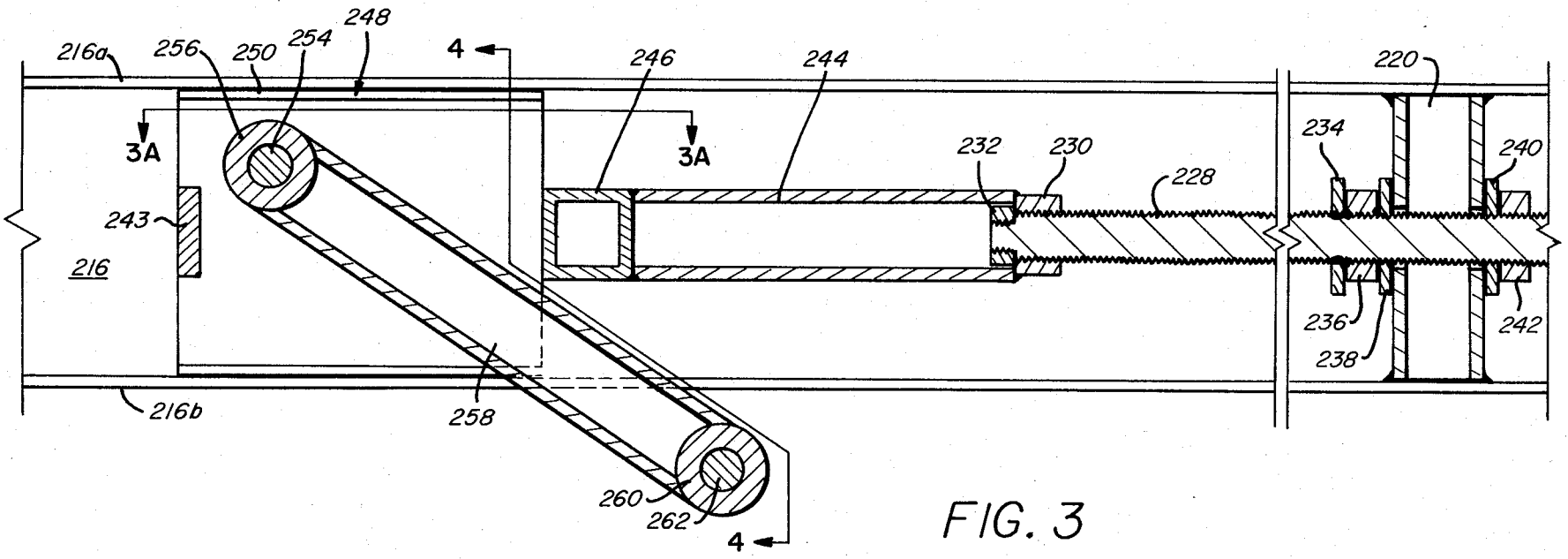
FIG. 3 is a detailed elevation showing, in part, means for adjusting the angle between the two horizontal members of the bracket along line 3—3 shown in FIG. 4.

Rod 224 is carried by "C" channels 214 and 216 for adjusting the angle between the first horizontal member 202 and the second horizontal member 204 and carried by plate 218 at the distal end of the second horizontal member 204. Attached to rod 224 is adjusting nut 226 at the outer end of second horizontal member 204 and bearing against plate 218 through washer 219 which is accessable from above when the bracket 200 is in position for use, thus not only providing from horizontal adjustment of the angle of the formwork F but making such adjustment easily accomplished. Rod 224 extends through holes in end plate 218 and is carried intermediate the ends by rectangular tube 220 welded to channels 214 and 216. On the promximal end of rod 224 is threaded portion 228. Referring to FIG. 3, the threaded portion 228 is threadably connected to nut 230 which moves back and forth laterally along threaded portion 228 when rod 224 is rotated by turning adjusting nut 226. Attached to the end of threaded portion 228 is a stop 232 which restricts threaded portion 228 from being disconnected from nut 230 when rod 224 is rotated as well as restricting movement of means for adjustment of the angle between the first and second horizontal members, 202 and 204, respectively. Opposite stop 232 end on threaded section 228 is washer 234, nut 236 and washer 238 adjacent to rectangular tube 220 on the side nearest nut 230. On the opposite side of rectangular tube 220 from washer 238, are washer 240 and nut 242, located on threaded section 228 of rod 224. Both nuts 236 and 242 are rigidly connected, welded, for example, to threaded section 228 and rotate with rod 224 to prevent movement thereof when adjusting nut 226 is rotated. Washers 234, 238, and 240 are preferably made of a hardened steel to provide along life bearing surfaces. Washer 234 acts to prevent friction binding between nuts 230 and 236 while washers 238 and 240 act to provide a bearing surface between nuts 236 and 242, respectively, and rectangular tube 220. Between nut 242 and nut 226, where rod 224 passes through, and turns freely within, rectangular tube 220, rod 224 can be made of standard pipe or similar material capable of withstanding the torque forces exerted when angle adjusting nut 226 is turned.

Figure 4:
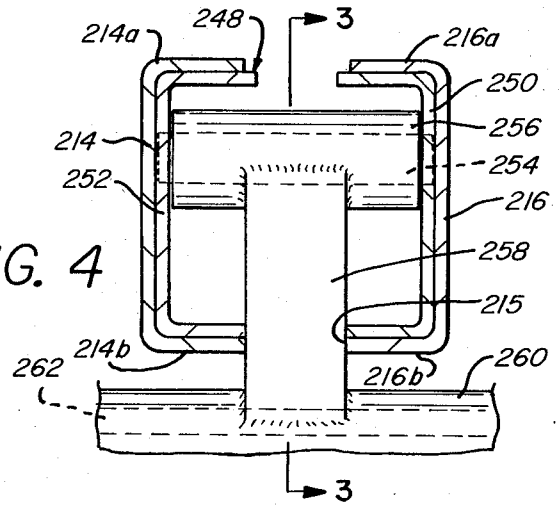
FIG. 4 is a section view along line 4—4 of FIG. 3 showing the means for adjusting the angle between horizontal members.
Figure 3A:
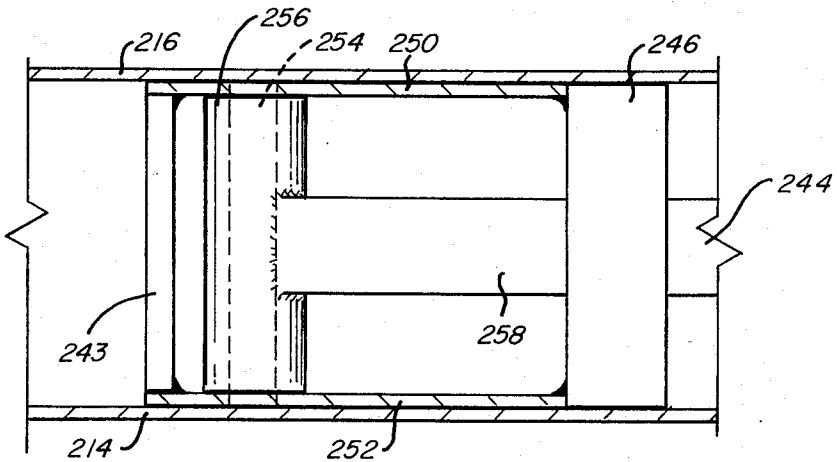
FIG. 3A is a section view along line 3A—3A of FIG. 3 showing the laterally sliding box as the means for adjusting the angle between the first and second horizontal means.

Nut 230 is rigidly attached i.e., welded, to sleeve 244 which can either be square or rounded as long as sleeve 244 has inside dimensions which are greater than the diameter of both stop 232 and threaded section 228 to allow sleeve 244 to move back and forth when rod 224 rotates. Sleeve 244 is rigidly connected to a transition brace 246 which in turn, is rigidly connected to laterally sliding box 248. Transition brace 246 shown as a square tube (though an angle or channel iron would suffice) orthogonally connected to sleeve 244 and at its outer edge connected to a laterally sliding box 248. Referring to FIG. 4, box 248 is preferably constructed of "C" channels 250 and 252 which face each other and, as shown in FIG. 3A, are connected at each end by transition brace 246 and spacer 243. Outer dimensions of channels 250 and 252 are slightly less than inside dimensions of 214 and 216 so that sliding box 248 slides, without binding, along the inner walls of 214 and 216. Sliding box 248 is connected to a rotatable cylinder 256 through pin 254 (FIG. 3). Cylinder 256 rotates around pin 254 in response to movement imparted to sliding box 248 through rotation of adjusting rod 224. Link 258 is connected to cylinder 256 on one end and on the other end to cylinder 260. Cylinder 260 is in turn pivotally connected to first horizontal member 202 through pin 262. Adjustment in the height and slope of second horizontal member 204 occurs by turning adjusting nut 226 which in turn rotates rod 224 causing nut 230 and thus sliding box 248 to traverse laterally, resulting in rotation of link 258 and cylinder 260 about pin 262 and in turn causing the end of second horizontal member 204, proximate the beam 10, to move up and down relative to pin 262 and first horizontal member 202 depending upon the direction of movement of box 248. A slot 215 (FIGS. 2 and 8) between channels 250 and 252 of sliding box 248 and between lower flanges **214*b* and 216*b* of channels 214 and 216 must be at least of such width to allow passage of link 258 as box 248 makes its lateral traverse. As link 258 approaches a vertical orientation, the proximal end of the second horizontal member 204 reaches its highest position and, conversely, as link 258** approaches a horizontal orientation to said proximal end becomes lower.

Referring back to FIG. 1, first horizontal member 202 consists of arms 302 and 304 (FIG. 1A) oriented on opposite sides of second horizontal member 204. Arms 302 and 304 are connected via pin 210 which extends through second horizontal member 204 or may be journaled into channels 214 and 216 on either side of second horizontal member 204. Pin 210 provides the point about which second horizontal member 204 rotates to be angularly adjusted relative to arms 302 and 304 of the first horizontal member 202. Arms 302 and 304 are connected at the end proximate to the beam 10 through mounting cylinder 306. Mounting cylinder 306 includes stabilizing collar 308 and stabilizing disc 309 (FIG. 9) when a double frustum is used as the substantially vertical connector 310. Alternative configuration (FIG. 9A) of vertical connector 310 are to be discussed later.

Figure 9:
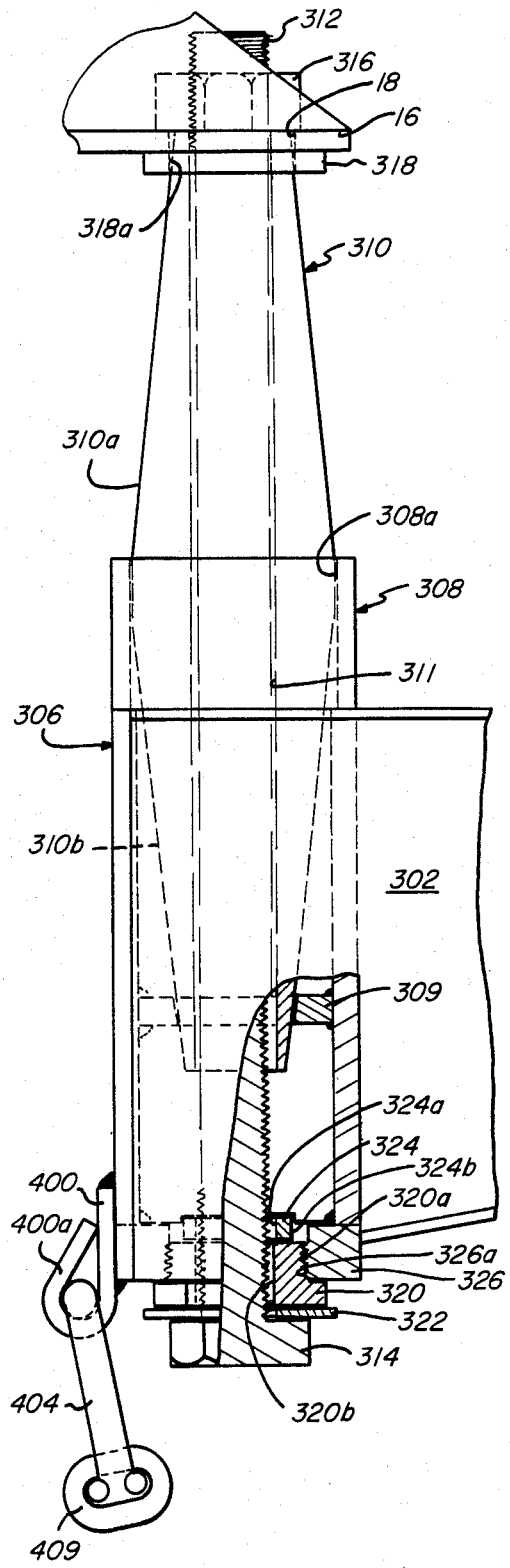
FIG. 9 is a detailed view of the hanger bolt and substantially vertical connector means as shown in the double frustum conical configuration for holding the bracket against the beam.

Referring to FIG. 9, the substantially vertical connector 310 employs a double conical frustum shown as 310*a* and 310*b* having a central longitudinal channel 311 adapted to receive and pass through bolt 312. Cylinder 306 is also recessed to accept the lower half 310*b* of double frustum of connector 310. The connector can be reversed to insert frustrum 310*a* which is of a different height than frustrum 310*b* in order to optionally vary the height at which bracket 200 is held relative to the beam 10 as mentioned earlier.

Bolt 312 is connected to bolt head 314 and extends upward beyond nut 316. When the bracket 200 is in place, nut 316 bears against the upper surface of hanger 16. On the under side of hanger 16 is washer 318 having an inner bore 318*a* of sufficient diameter to receive the small diameter end of either frustum 310*a* or 310*b*. The inner bore 318*a* of washer 318 and inner recess 18 of hanger 16 cooperate to absorb horizontal forces exerted by load on the distal end of bracket 200. Washer 318 is rigidly attached to the bottom of hanger 16 such that recess 18 and bore 318*a* coincide. The tightening of nut 316 against hanger 16 draws the upper end of the upper frustum 310*a* into the interior bore 318*a* of washer 318 and recess 18 thereby causing all horizontal forces to be transmitted directly from the upper frustum 310*a* to hanger 16 thereby releiving bolt 312 of any horizontal loading, a great advantage of the invention. Alternatively, the horizontal forces can be transmitted from upper frustum 310*a* through bolt 312 to hanger 16 that would require bolt 312 to be of substantially greater size and weight and would interfere with subsequent withdrawal to recover bracket 200. Since the upper frustum 310*a* and lower frustum 310*b* of the connector 310 will preferably be of different lengths, reversing the upper and lower ends of connector 310 effectively changes the vertical distance from hanger 16 to the top of arms 302 and 304 and thereby permits an adjustment to either vary the vertical position of wooden deck 110 relative to hanger 16, or optionally to vary the depth of wooden form pieces 102, 104, 106, and 108. Adjacent to head 314 and surrounding hanger bolt 312 is washer 322, keeper nut 320 and stop 324 passing through anchor plate 326 of mounting cylinder 306. Anchor plate 326 is rigidly attached to the lower end of cylinder 306 and has an interior threaded hole 326*a* to receive the exterior threads 320*a* of keeper nut 320. Keeper nut 320 is a relatively short bolt threaded on the outside to match the interior threads 326*a* of anchor plate 326, attached to a relatively short nut 320, and with a central bore 320*b* of a size to allow passage of bolt 312, without threading, in a reasonably close fit. Stop 324 is a washer with an inside diameter 324*a* to fit outer bolt 312 in a snug fit and an outside diameter 324*b* to easily fit inside the threaded hole 326*a* in anchor plate 326.

An independent assembly is fabricated by slipping, in sequence, washer 322, keeper nut 320, with the hex portion adjacent to washer 322, and stop 324 over bolt 312 and then rigidly attaching stop 324 to bolt 312. By inserting the threaded portion 320*a* of keeper nut 320 into the threaded recess 326*a* of anchor plate 326 and tightening by use of a wrench applied to keeper nut 320, bolt 312 is attached to bracket 200 in a manner that permits rotation of bolt 312 but restricts lateral movement relative to bracket 200. By this means, bracket 200 is attached to hanger 16 by threading into nut 316 through washer 318 and recess 18 in hanger 16. The bracket 200 is removed from the cured concrete by backing bolt 312, assisted by the withdrawal of keeper nut 320, out of nut 316, which is fixed and abandoned with the hanger 16 in cured concrete. Once withdrawn from the concrete, the hole left by the frustrum 310*a* of connector 310 is filled with concrete.

Figure 9A:
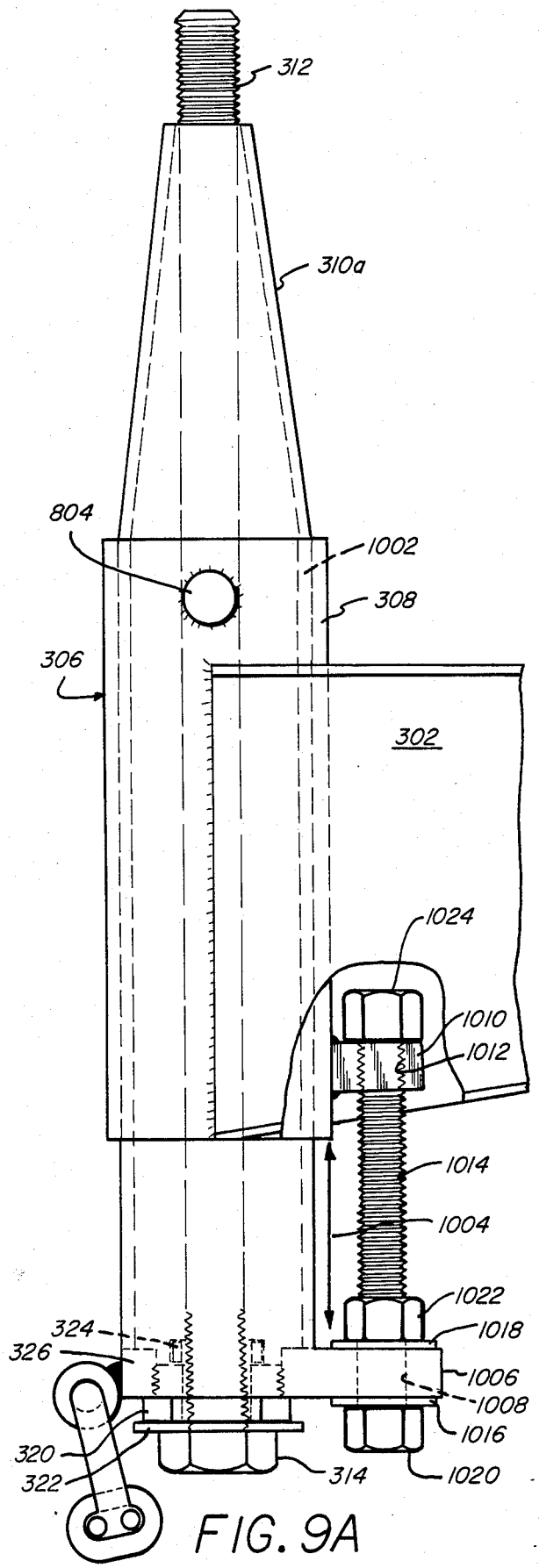
FIG. 9A is a detailed view of an alternative embodiment of the substantially vertical connector means for holding the bracket against the beam employing a cylindrical connector which is adjustable for elevation.

Referring to FIG. 9A, an alternative to the double frustum substantially vertical connector 310 with different length upper half 310*a* and lower half 310*b* to vary the vertical distance from hanger 16 to the top of arms 302 and 304, of the first horizontal member 202 is shown. A single frustum 310*a* is rigidly attached to cylinder 1002 which extends down through stabilizing collar 308 and mounting cylinder 306 in a sliding fit, to a distance below the cylinder 306 substantially equal to the adjustable stroke distance 1004. Anchor plate 326 in this instance is rigidly attached to the lower end of cylinder 1002 instead of cylinder 306. The connector 310 again has a central axis to pass bolt 312. Attachment of bolt head 314, hanger bolt 312, washer 322, keeper nut 320, and stop 324 to anchor plate 326 remains as described above in connection with FIG. 9. Rigidly attached to anchor plate 326 is lower lobe 1006 with smooth bore 1008 and rigidly attached to mounting cylinder 306 is an upper lobe 1010 with threaded bore 1012. Smooth bore 1008 and threaded bore 1012 are in axial alignment so that threaded bolt 1014 passes through bore 1008 in lower lobe 1006, with a loose fit, to mate with threaded bore 1012 in upper lobe 1010. Threaded bore 1014 has a head 1020 and carries threaded nuts 1022 and 1024, as well as house washers 1016 and 1018. Head 1020, washers 1016 and 1018, and nut 1022 are arranged and secured to prevent lateral movement of threaded bolt 1014, relative to cylinder 1002, when threaded bolt 1014 is rotated. Nut 1024 may, optionally, be spot welded to upper lobe 1010 in axial alignment with threaded bore 1012 in order to allow the easy threading of bolt 1014 and subsequent adjustment without need for a back up wrench. Rotation of threaded bolt 1014 causes said bolt 1014, cylinder 1002 and frustum 310*a* to move laterally relative to mounting cylinder 306 and arms 302 and 304, thereby varying the distance from hangers 16 to top of arms 302 and 304, providing the adjustment advantages previously mentioned.

Figure 5:
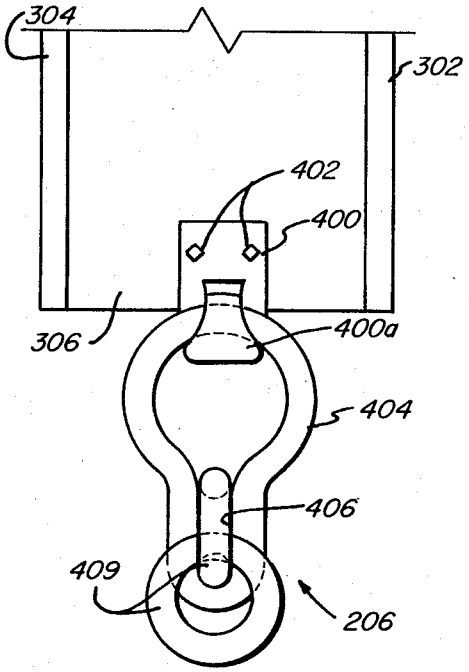
FIG. 5 is an end view along line 5—5, shown in FIG. 1, of the connection between the first horizontal member and the tension member.

Referring to FIG. 1 and FIG. 5, vertical tension member 206 is connected to first horizontal member 202 via plate and hook assembly 400. Bolts 402 hold the plate 400 and hook 400*a* in place against mounting cylinder 306. Grab link 404 is hung in the hook 400*a* of plate 400. The grab link is substantially in the pattern shown in FIG. 5 so that when a chain is used as is the preferred vertical tension member 206, the links can be pulled through the wide circular section 404 and then secured in the more narrow section 406, locking the link in place at the desired length. This arrangement for securing a chain is well known. This chain adjustment makes the length of vertical tension member 206 adjustable to position the compression member 208 of the bracket 200 against the beam 10.

Figure 6:
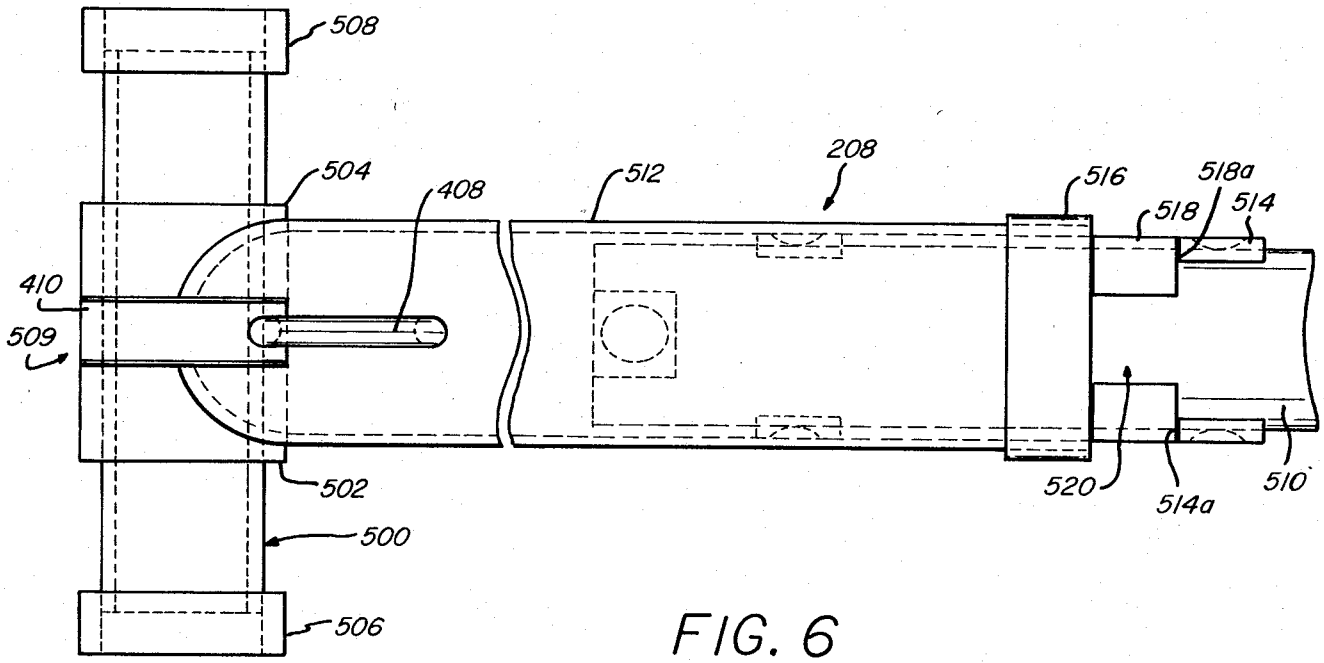
FIG. 6 is a top view along line 6—6 of FIG. 1 showing the locking means for the adjustable compression diagonal member in locked position.

Referring to FIG. 6, opposite the connection to grab link 404 along member 206 is terminal link 408 attached to collar 410. Collar 410 surrounds, and is free to rotate about, pin 500 when link 408 moves. Pin 500 also acts as the proximal support for diagonal compression member 208 through cylinders 502 and 504 attached on opposite sides of cylinder 410, to 500. Attached to the ends of pin 500 are stabilizing cylinders 506 and 508 which are the same, or slightly larger, outside diameter as cylinders 502, 504 and 410. Stabilizing cylinders 506 and 508 act to prevent compression member 208 from rotating once the bracket is in place against the beam 10 (FIG. 1). Pin 500, orthogonally attached to compression member 208 forms a "T" head to stabilize the bracket 200 when in place and bearing against the outer surface of the bridge beam 10. Though not necessary, preferably all of these cylinders, namely, 502, 504, 506, 508 and 410 bear against outer most beam 10 against side 12 when the bracket 200 is in place and the pin 500 oriented substantially horizontal.

Referring back to FIG. 1, diagonal compression member 208 is made of two circular telescoping pipes, 510 and 512. Equally spaced, preferably, on and at opposite sides of the first circular pipe 510 are projections 514 which make the width or diameter of first pipe 510 greater at the location of each pair of projections. The diameter of the telescoping first pipe 510 including the projections 514, is less than the inside diameter of second circular sleeve pipe 512 so that inside pipe 510 including projections 514 can slide into and out of second sleeve pipe 512.

Attached to the telescoping end of second circular pipe 512 is collar 516. Attached to collar 516 are segments 518 which lock between the pairs of projections 514 by rotating second circular pipe 512 along with attached collar 516 and the segments 518 such that the outer surfaces 518*a* of segments 518 bear against surfaces 514*a* of projections 514, thus transmitting the compressive forces exerted by a load on second horizontal member 204 through compression leg 208 and thence to the side 12 of beam 10.

Figure 7:
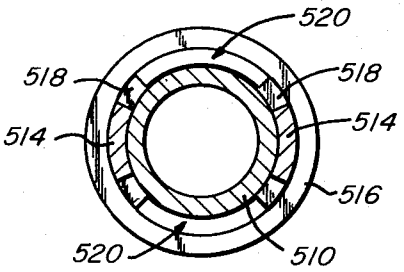
FIG. 7 is a cross-sectional view along line 7—7, shown in FIG. 1, of the length adjustment feature of the diagonal compression member.

Openings 520 (FIG. 7) between each of the two segments 518 are provided to allow passage of projections 514 when pipe 512, collar 516 and segments 518 are rotated. In a preferred embodiment, when pipe 512 is rotated 90°, openings 520 line up with projections 514, thereby allowing sleeve 512 to slide back and forth over pipe 510 to adjust the length of the compression leg to the length needed to support the bracket 200 against beam 10 in the position desired. When the desired length is reached, pipe 512 is rotated back 90° (in the embodiment shown) so that collar segment surfaces 518*a* bear upon projected surfaces 514*a* which is held in place when compression member 208 with the "T" head 509 is stabilized against the side 12 of the beam 10. Preferably, the projections 514 and segments 518 are oriented on pipes 510 and 512, respectively, such that pin 500 is horizontal when the compression member 208 is in the locked position as shown in FIG. 1.

The distal end of diagonal compression member 208 is attached to travelling carriage 524. Carriage 524 in turn is connected to second horizontal member 204 by threaded rotatable rod 526, shown in FIG. 1 carried below the second horizontal member through plate 218 and sleeve 532. The carriage 524 travels laterally in response to the rotation of rod 526 by nut 528, moving the location of the pin 522. A loose hardened washer 530 is attached to rod 526 between plate 218 and nut 528 to prevent the nut from binding against the surface of plate 218.

Figure 8:
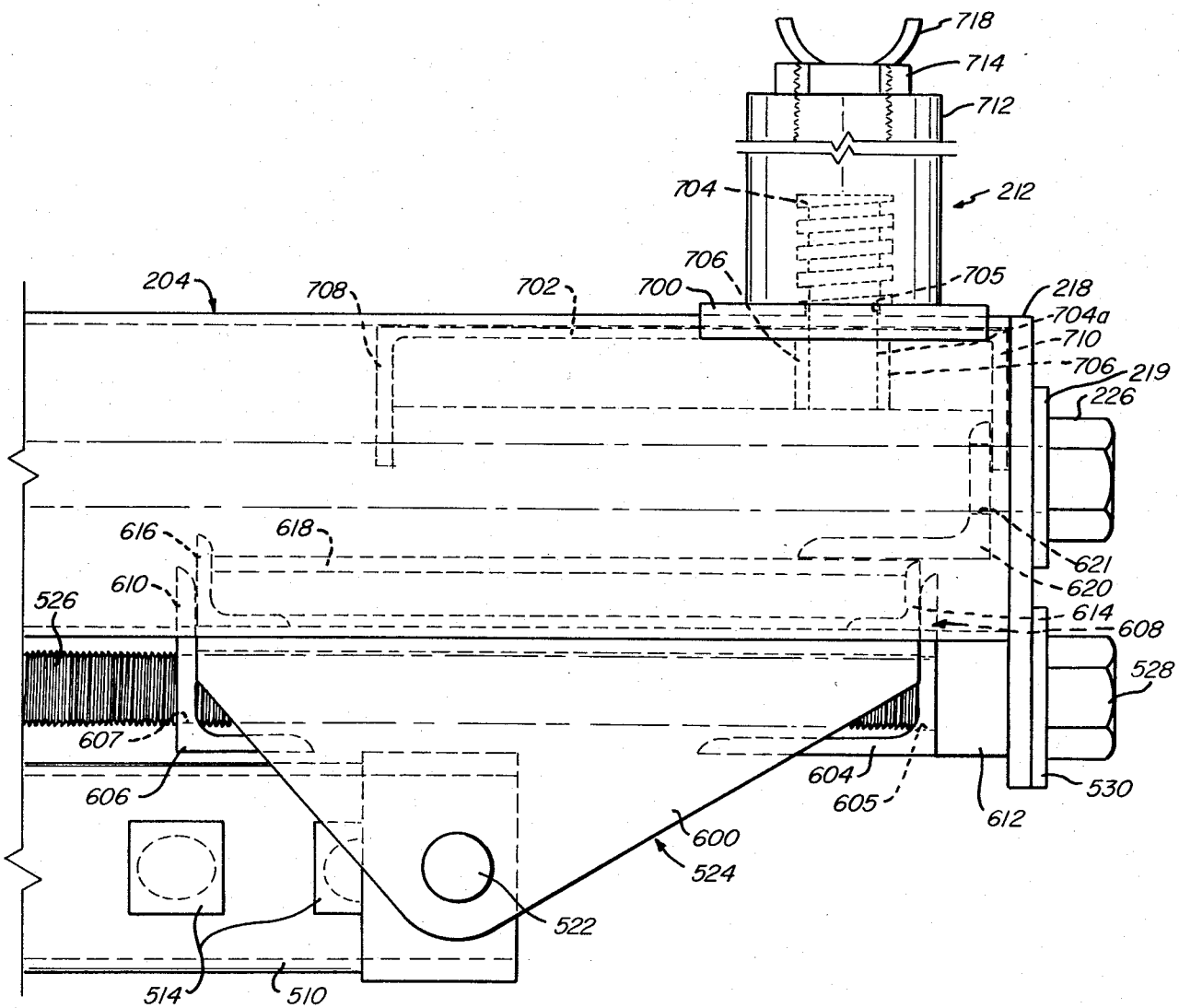
FIG. 8 is a side elevation of an embodiment of the end of the bracket distal the beam.

Referring first to FIG. 2, carriage 524 is comprised of a "C" channel with two triangular shaped flat plate legs 600 and 602. These plate legs 600 and 602 have holes 601 and 603, respectively, to receive pin 522 as shown and are further connected to each other with angles 604 and 606 (FIG. 8) which are welded to the ends of carriage 524. Referring to FIG. 8, both angles 604 and 606 have vertically disposed tabs 608 and 610, respectively, which extend through a guide slot 215 between the lower flanges 214*b* and 216*b* of second horizontal member 204. The upper surface of carriage 524 bears upon and moves in contact with the lower flanges 214*b* and 216*b* making up the second horizontal member 204. Attached to tabs 608 and 610 are transversely mounted angles 614 and 616, respectively, which rest upon, and are carried by, the inside of lower flanges 214*b* and 216*b* of second horizontal member 204. Angles 604 and 606 have holes 605 and 607, respectively, through which threaded rod 526 extends. Attached to angle 604 opposite plate legs 600 and 602 is nut 612 which is threaded upon threaded rod 526. When nut 528 is rotated, nut 612 will move laterally in response to such rotation causing the carriage 524 to move laterally. As shown in FIG. 8, the carriage is at its outer most location possible when nut 612 abuts plate 218. The carriage 524 is stabilized by a longitudinal oriented angle 618 bridging the space between angle 614 to angle 616. To hold rod 526 in place at the end opposite plate 218, sleeve 532 is attached (welded) to lower flanges 214*b* and 216*b* on the underside of second horizontal member 204. Rod 526 extends through sleeve 532 and has nut 534 attached to the end with loose hardened washer 536 positioned between nut 534 and sleeve 532. Nut 532 can be secured to the threads of rod 526 in any well known means, such as with a cotter key, to cause the nut 534 to rotate with rod 526.

As an alternative embodiment (not shown), rod 526 could be a hollow threaded rod oriented coaxially with, but independent of, rod 224 such that the adjusting nuts 528 and 226, respectively, are also coaxial. Thus both adjusting rods would be carried within the second horizontal member 204. Such a change in orientation might be dictated or suggested to balance bending moments caused by loading on the brackets. Changes in position of other parts described herein to adapt to the alternative would be within the skill of the average engineer.

Lateral movement of carriage 524, in response to the rotation of nut 528 which in turn rotates rod 526 causing nut 612 to move carriage 524, repositions pin 522 which connects the first cylindrical pipe 510 of the compression member 208 to its desired position. The first pipe 510 is connected to carriage 524 in a rotatable manner through pin 522. Movement of carriage 524 changes the position of the distal end of compression member 208, thus adjusting the grading of the concrete pour.

Note from the foregoing discussion that the angle of the first horizontal member 202 with respect to the second horizontal member can be adjusted by turning nut 226 and the diagonal compression member 208 can be adjusted by turning nut 528. It is a great advantage of this invention that both adjustments can be made with the bracket 200 in place supporting formwork F from above on the formwork F itself. No external scaffolding is necessary. Must time is saved and much danger to workers avoided because of this.

Shown further in FIG. 8 is rail support means 212. Rail support 212 is attached to second horizontal member 204 through "C" channels 700 and 702. Outside channel 700 has its lower surface in slidable contact with the uppermost surface of the flanges 214*a* and 216*a*. The inside channel 702 is mounted inside the upper flanges 214*a* and 216*a* and has its upper surface abutting the lower face of the inside surfaces of upper flanges 214*a* and 216*a*. Shaft 704 is a threaded shaft with a reduced diameter unthreaded lower extension 704*a*. Extension 704*a* passes through a loose fitting hole 705 in "C" channel 700 and through a guide slot 217 between the upper flanges 214*a* and 216*a* of second horizontal member 204 and is rigidly attached to "C" channel 702 through two stiffner plates 706 on either side of lower extension 704*a*. The hole 705 is of a smaller diameter than the threaded portion of shaft 704 so that "C" channel 700 cannot be removed by lifting it upwardly off the threaded shaft 704; however, a short length of extension 704*a* is left between the top surface of "C" channel 700 and the bottom surface of the threaded portion of shaft 704 to provide a loose fit between "C" channels 700 and 702, and flanges 214*a* and 216*a* so that the rail support means 212 can easily slide laterally along upper flanges 214*a* and 216*a*. When threaded sleeve 712 is rotated, usually clockwise, it cooperates with the threads of shaft 704 to urge channel 700 toward channel 702, pinching flanges 214*a* and 216*a* in between and locking the rail support 212 in place. Channel 702, which can alternatively be an oversized washer in flat slots, has plates 708 and 710 attached at opposite ends to give the assembly support and to provide a means for indexing the positions of the rail support means 212 and the diagonal compression member 208.

To keep the bracket stabilized when loads are imposed on the rail support 212, a stop means 620 shown as an angle iron is attached to transverse angle 614 and to stabilizing angle 618 of carriage 524. Stop means 620 is oriented between, and extends above, the bottom of flange end pieces 710 and 708 of channel 702. In this manner, the rail support member is restricted in its lateral displacement relative to the carriage 524. Stop means 620 is provided with passageway 621, so that when carriage 524 or rail support device 212 are moved, rod 224 will rotate freely within passageway 621.

When a load is imposed upon the rail support 212, the resulting bending moment created in second horizontal member 204 will be kept within working range due to the limiting of the load's eccentricity. Rail support 212 is further comprised of secondary vertical section 714, telescoping into sleeve 712 and adjustable in height from second horizontal member 204 by means well known to one skilled in the art. Direct contact with concrete placing or finishing machines is made on rails 716 shown on FIG. 1 and carried by retainer 718.

Figure 10:
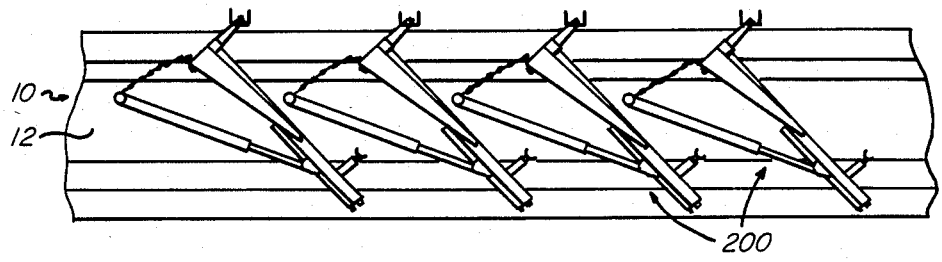
FIG. 10 is an elevation view of a beam showing brackets hung at rest from the hangers in the preliminary erection position.
Figure 10A:
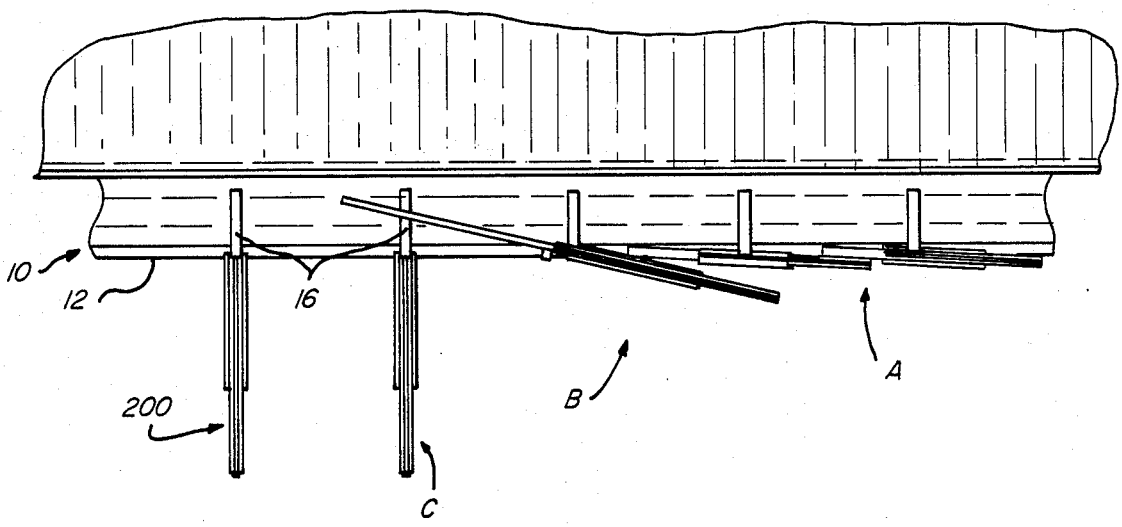
FIG. 10A is a top view of brackets attached to a beam in various stages of final erection.
Figure 10B:
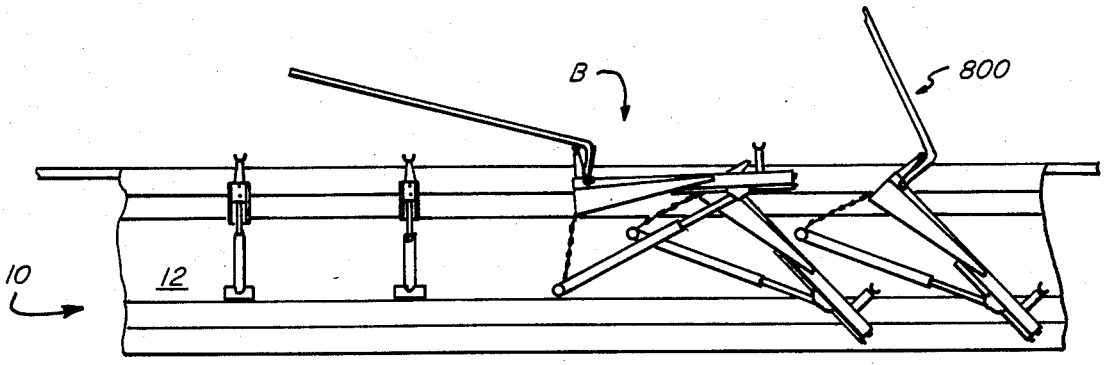
FIG. 10B is an elevation view of the brackets in various stages of final erection corresponding to the position shown in FIG. 10A.
Figure 11:
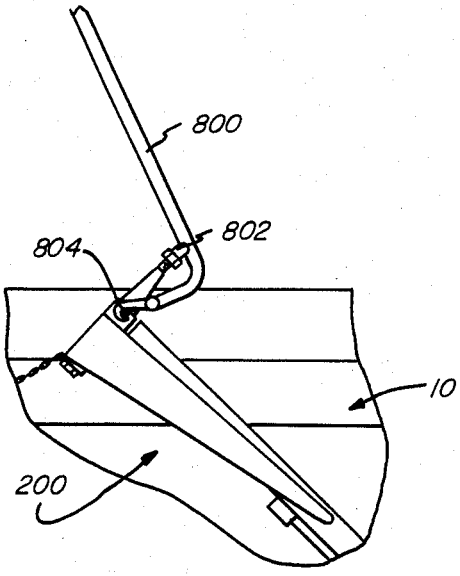
FIG. 11 is an elevation view of the initial step of final erection of a single bracket showing the erection tool in lifting position on the bracket.

Referring to FIGS. 10, 10A, and 10B, the steps in erecting the bracket on the beam 10 are shown. The bracket 200 is loosely hung on the hanger 16 of threaded bolt 312 through hole 18 and installing nut 316. The bracket 200 is allowed to rest on the side 12 of the beam 10 as shown in FIG. 10 and position A shown on 10A and 10B. Erection procedure begins with lever bar 800 attached to the bracket substantially as shown in FIG. 11. The lever bar works by sitting in a recess 802 provided on lever bar 800 using the top of the bolt 312 of the bracket 200 as a fulcrum and bearing against lugs 804 (FIG. 9A) extending from either side of the bracket, as shown in FIG. 11. After attaching the lever bar 800, the bracket 200 is raised to place first horizontal member 202 and second horizontal member 204 in a substantially horizontal position B as shown in FIGS. 10A and 10B. The lever bar 800 is rotated clockwise, placing the bracket 200 perpendicular to the beam 10, position C. Once the bracket 200 is in position C as shown in FIG. 10A, the lever bar 800 can be removed and nut 316, which is resting in the hanger 16, tightened in order to complete the attachment of the bracket to the hanger.

Figure 12:
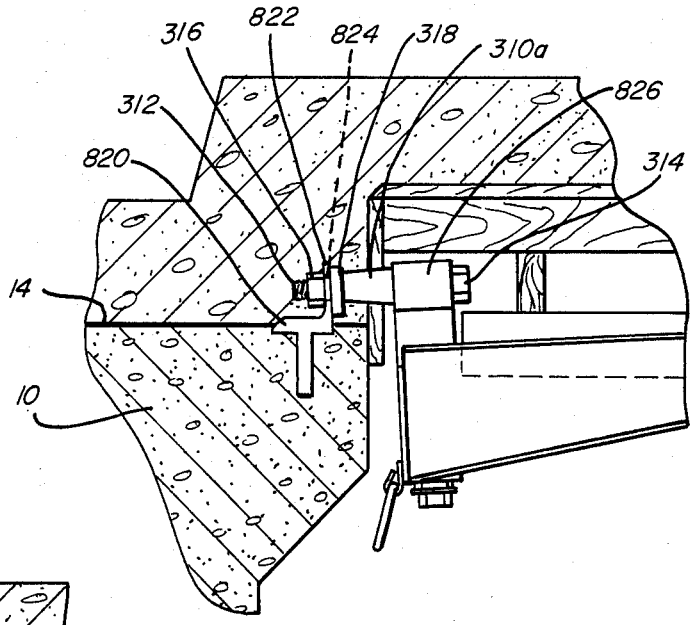
FIG. 12 is a sectional elevation view detailing an alternative hanger means.

In FIG. 1, a bracket in place supporting formwork and concrete is shown along with the hanger means whereby a "C" channel is provided with a hole 18 to support the bolt 312 and connector 310 in a substantially vertical position. FIG. 12 shows an alternative means for hanging the bracket off of a beam where angle iron 820 oriented with the longitudinal axis of beam 10 is rigidly attached to a beam 10 where one outer flat surface side of the angle is anchored against the beam so that a vertical flange 822 of the angle 800 extends perpendicular to the top surface of the beam 10. Vertical flange 822 is provided with a hole 824 whose axis is perpendicular to the longitudinal axis of the beam 10 and adapted to receive bolt 312 and frustum 310*a*. Surrounding frustum 310*a* adjacent to vertical flange 822 is washer 318 adapted to receive the top of frustrum 310*a* when bolt 312 is tightened. The frustum connection is similar to that shown in FIG. 1, except that the vertical forces are now directly transferred to the beam and the bolt 312 assumes horizontal forces only. Surrounding bolt 312 adjacent to frustum 310*a* is cylinder 826 having a substantially horizontal bore adapted to receive bolt 312 and in the manner shown in FIGS. 9 and 9A and the accompanying description thereof which is snug against bolthead 314 when nut 316 is tightened onto bolt 312. Horizontal cylinder 826 is attached to a vertical connector 310 and thence to the first horizontal member 202.

Figure 13:
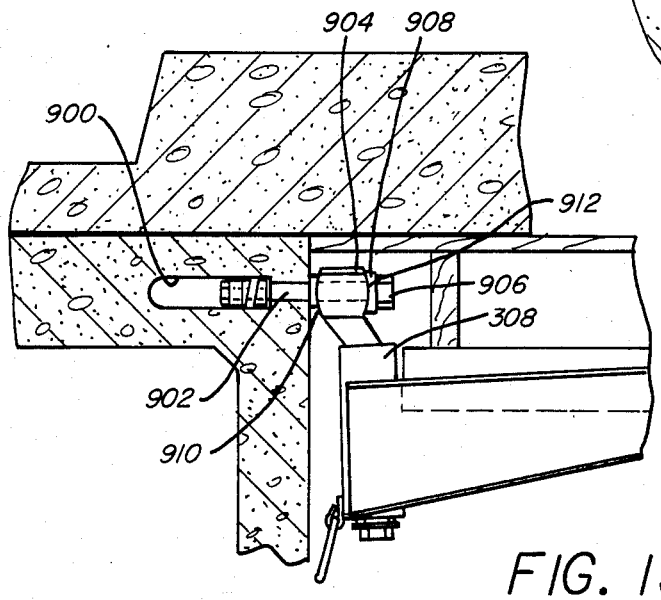
FIG. 13 is an elevation view detailing another alternative hanger means.

Referring to FIG. 13, yet another embodiment of hanger for connecting the bracket 200 off a beam 10 is shown. A substantially horizontal hole 900 is drilled in the outermost surface of a beam. An expansive anchor bolt 902 is then placed in the hole and rigidly attached with an epoxy adhesive, grouts or other commonly known materials. This bolt includes a second threaded end extending out horizontally past the outermost vertical surface of the beam to receive the substantially horizontally oriented bore of cylinder 904. Cylinder 904 is held in place by tightening nut 906 onto the bolt as shown. Nut 906 is stabilized by washer 908. Cylinder 904 is provided with rounded end surfaces 910 and 912. These rounded surfaces 910 and 912 bear against the vertical side of beam 10 and washer 908 to prevent eccentric loads from occurring if bolt 902 is not exactly horizontal end if adjustment of bracket 200 causes rotation about bolt 902 upon rounded edges 910 and 912. Horizontal cylinder 904 is attached to vertical cylinder 308 which connects to the bracket 200 in the manner as discussed previously in connection with FIGS. 9 and 9A with respect to adjustment of height of the horizontal members.

Having thus described the brackets and hangers of this invention, many modifications of the foregoing described invention can be made by, and will be apparent to, those skilled in the art from said description without departing from the scope of this invention as claimed.

I claim:

1. A bracket for supporting a deck outside a beam, attached to the beam by a hanger means, said bracket comprising:

a horizontal section composed of:

a first horizontal member rigidly attached to said hanger means by a substantially vertical connector means;

a second horizontal member pivotally connected to, and disposed in adjustable angular relation with, said first horizontal member;

means for adjusting the angle of said second horizontal member with respect to said first horizontal member; and bearing means in bearing engagement with the wall of said beam below said first member and said second member and interconnected with said first member and said second member for supporting part of the load on said bearing deck.

2. The bracket of claim 1 wherein the support means comprises:

a diagonal compression member pivotally connected to said second horizontal member distal of, and bearing against, a substantially vertical surface of the beam;

a tension member connected at one end to said first horizontal member and at the other end to said diagonal member at a point proximate the beam to aid in stabilizing said diagonal compression member.

3. The bracket of claim 2 wherein said hanger means comprises:

a structural channel rigidly attached to the top of the beam;

a recess in the horizontal plane of said channel located above the top surface and outside the outer substantially vertical surface of said beam;

a bolt extending substantially vertically through said recess;

a nut threadedly attached to said bolt above said recess bearing against said channel to secure said bracket to the beam.

4. The bracket in claim 2 wherein the means for angular adjustment between said second horizontal member to said first horizontal member comprises:

a rotatable rod housed within said second horizontal member;

a means for rotating said rod when the bracket is secured to the beam;

a threaded end portion of said rod opposite said rotation means;

a nut threadably attached to said threaded portion of said rod;

a laterally sliding box carried within said second horizontal member attached to said nut which moves laterally in response to rotation of said rod; and a link pivotally connected, at one end, to said laterally sliding box and to said first horizontal member at the opposite end such that lateral movement of said sliding box causes the link to pivot about its pivotal connections moving the second horizontal member about said pivotal connection with the first horizontal member to change the angle between said second horizontal member and said first horizontal member.

5. The bracket of claim 2 which includes a movable; adjustable rail support means carried by said second horizontal member.

6. The bracket in claim 5 wherein said rail support means comprises:

lateral adjustment means comprising a base slidably carried by said second horizontal member;

a threaded shaft attached to said base extending upwardly through said second horizontal member;

a threaded sleeve removably attached to said threaded shaft;

a clamping means for positioning said rail support means on said second horizontal member; and an adjustable telescoping vertical pipe carried by the threaded sleeve to adjust the height of the said support means.

7. The bracket in claim 6 where said clamping means comprises:

an outside channel oriented about said threaded shaft and carried by said second horizontal member which pinches and second horizontal member between said outside channel and said inside channel in response to a rotation of the threaded sleeve on said threaded shaft thereby preventing lateral movement of the rail support.

8. The bracket of claim 2 wherein the diagonal compression member is adjustable in length.

9. The bracket in claim 8 wherein the adjustable diagonal member comprises:

a first circular pipe;

a plurality of spaced raised projections oriented along the length of said first circular pipe;

a second circular pipe of sufficient inside diameter to allow said first circular pipe with raised projections to telescope within said second circular pipe;

a segmented collar attached to the telescoping end of said second circular pipe the internal diameter of said segments having sufficient inside diameter to allow passage of said first pipe but not said projections whereby the length of the diagonal member can be changed by passing the projections between the segments while telescoping the first and second pipes and said length can be locked by positioning said segments against said projections by rotating said second pipe.

10. The bracket of claim 9 wherein two rows of spaced projections are oriented on opposite sides of said first pipe.

11. The bracket of claim 2 wherein the pivotal connection between said diagonal member and said second horizontal member includes a lateral adjustment means for changing the longitudinal position of the pivotal connection along the portion of said second horizontal member distal the beam.

12. The bracket in claim 11 wherein the adjustment means for changing the position of the pivotal connection between said second horizontal member and said diagonal member is comprised of:

a lateral rod rotatably carried by said second horizontal member;

a carriage threadably attached to said lateral rod for later movement in response to rotation of said lateral rod;

a pin rotatably connecting said carriage to said diagonal member to allow rotation of said diagonal member about said pin in response to lateral movement of said carriage.

13. The bracket in claim 7 wherein said rail support means includes a stop means between said rail support means and said lateral adjustment means limiting lateral movement of said lateral adjustment means to prevent load superimposed on the rail support means from inflicting an excessive bending moment upon said bracket.

14. The bracket of claim 1 which includes as the substantially vertical connector an adjustable attachment means between said hanger means and said first horizontal member.

15. The bracket of claim 14 wherein the attachment means between said hanger means and said first horizontal member comprises:

a double conical frustum having a conical frustum at each end and a channel through its center adapted to receive said bolt wherein the frustums are of differing lengths whereby said double conical frustum can be reversed in position through which said bolt extends; and a cylinder in said first horizontal member to receive and retain either end of said double frustum ends with said bracket in place to vary the height of the bracket relative to the hanger.

16. The bracket of claim 14 wherein the attachment between said hanger means and said first horizontal member comprises:

a single conical frustum at one end with a central bore to receive a bolt;

a cylinder on a common axis with said frustum with said bolt for attaching the first horizontal member of said bracket extending through the central bore of both said frustum and said cylinder;

a lower lobe bored to pass a bolt, rigidly attached to said cylinder;

an upper lobe with a threaded bore attached to said first horizontal member in axial alignment with the bore in said lower lobe; and a second bolt being engaged through the bore of said lower lobe and threaded into the upper lobe such that rotation of said bolt displaces said cylinder and frustum relative to said first horizontal member.

17. In combination with a bracket for supporting forms for pouring concrete on a bridge overhang, a hanger for attaching the bracket to a beam to support forms for pouring concrete which comprises:

a means for anchoring a first end of a load bearing member to the beam;

a load bearing member having a first end attached to the beam and a second end adapted to receive and retain a connector with a substantially vertical longitudinal axis having a central bore therethrough; and a means for securing the bracket to said connector such that the bracket and connector may be removed from the beam without damaging the poured concrete.

18. The hanger and bracket combination of claim 17 wherein the load bearing means for attaching the bracket to the beam comprises:

a "C" channel attached at its first end to the top of the beam and extending beyond the outermost vertical plane of said beam;

a hole in the horizontal plane of said "C" channel proximate the second end of the channel extending beyond the outermost vertical plane of said beam;

a bolt engaged in said hole in a substantially vertical position being secured by a nut threadably engaged on said bolt;

a substantially vertical connector having upper and lower connecting ends being carried, and secured to the bracket, by said bolt;

a cylinder attached to the bracket adapted to receive and retain the lower end of the substantially vertical connector when the bolt is secured by the nut.

19. The hanger and bracket combination of claim 17 wherein the means for attaching the bracket to the beam comprises:

a connector as the load-bearing means;

an angle iron rigidly attached to the top of said beam so that one side of said angle is in a substantially vertical position and aligned with the longitudinal axis of the beam;

a hole in the vertical side of said angle having an axis perpendicular to the longitudinal axis of the beam adapted to receive the first end of the connector and bolt;

the connector for removably attaching the bolt to the bracket comprising a cylinder, having a substantially horizontal axial bore to receive a bolt as the second end, attached to a cylinder secured to the bracket and aligned to have a substantially vertical axis;

a substantially horizontal bolt passing through the substantially horizontal axial bore and said hole in the angle iron;

a nut threadably engaged on said bolt adjacent to said vertical side of said angle to secure said connector to the beam.

20. The hanger and bracket combination of claim 17 wherein the means for attaching the bracket to the beam comprises:

an expandable anchor bolt as the load-bearing means threadably engaged at its first end and secured within a substantially horizontal hole in the outermost substantially vertical surface of the beam and having a threaded shaft on its second end extending horizontally from the beam;

a cylinder having a substantially horizontal axial bore adapted to receive the threaded shaft of the second end of the load-bearing means and removably attached thereto; said cylinder having rounded surfaces on both ends bearing against the beam and a means for securing same upon threaded shaft to allow reorientation of the bracket against the beam;

a second, vertically oriented cylinder attached to the substantially horizontal cylinder and adapted to be attached to the bracket to secure same in position; and a bracket for supporting a form for pouring concrete attached thereto.

21. A method for positioning an overhang support bracket on a beam having a top horizontal surface and inner and outer vertical surfaces comprising the steps of:

hanging said bracket upon a hanger attached to the top of the beam by placing a nut on a bolt passing through the bracket, connector and the hanger and allowing said bracket to rest against, and parallel to, the outer surface of the beam;

attaching a lever bar tool to a lug on said bracket and raising said bracket to a substantially horizontal position using the top of a hanger bolt as a fulcrum;

rotating said bracket with said attached lever bar to a position horizontally outward of, and substantially perpendicular to, the beam such that the top surface of the beam and the top of said bracket are in substantially the same horizontal plane;

securing said bracket in place to said hanger by tightening said nut; and removing the lever bar tool.

* * * * *

UNITED STATES PATENT AND TRADEMARK OFFICE

CERTIFICATE OF CORRECTION

PATENT NO. : 4,660,800

DATED : April 28, 1987

INVENTOR(S) : Eugene A. Horstketter

It is certified that error appears in the above-identified patent and that said Letters Patent is hereby corrected as shown below:

In column 4, line 27 after "17" delete "by" and insert therefor -- of --.

In column 5, line 11 delete "steps" at the beginning of the line and insert therefor -- stage --.

In column 5, line 48 after "providing" delete "from" and insert therefor -- for --.

In column 5, line 53 after "the" delete "promximal" and insert therefor -- proximal --.

In column 6, line 5 after "provide" delete "along" and insert therefor -- long --.

In column 7, lines 12 and 13 delete "frustrum" and insert therefor -- frustum --.

In column 7, line 31 after "thereby" delete "releiving" and insert therefor -- relieving --.

In column 8, line 8 delete "frustrum" and insert therefor -- frustum --.

In column 9, line 48 after "upon" delete "projected" and insert therefor -- projection --.

In column 10, line 30 after "Nut" delete "532" and insert therefor -- 534 --.

In column 10, line 61 after "necessary" delete "Must" and insert therefor -- Much --.

In column 11, line 9 delete "stifner" and insert therefor -- stiffener --.

In column 12, line 19 after "of" delete "frustrum" and insert therefor -- frustum --.

UNITED STATES PATENT AND TRADEMARK OFFICE

CERTIFICATE OF CORRECTION

PATENT NO. : 4,660,800

DATED : April 28, 1987

INVENTOR(S) : Eugene A. Horstketter

It is certified that error appears in the above-identified patent and that said Letters Patent is hereby corrected as shown below:

In column 12, line 47 after "horizontal" delete "end" and insert therefor -- and --.

In column 13, claim 3, line 32, delete "threadedly" and insert therefor -- threadably --.

In column 14, claim 12, line 52 delete "later" at the beginning of the line and insert therefor -- lateral --.

Signed and Sealed this

Thirteenth Day of October, 1987

*Attest:*

DONALD J. QUIGG

*Attesting Officer*

*Commissioner of Patents and Trademarks*